US010551134B2

(12) United States Patent
Carlson et al.

(10) Patent No.: US 10,551,134 B2
(45) Date of Patent: Feb. 4, 2020

(54) HEADER FOR A HEAT EXCHANGER, AND METHOD OF MAKING THE SAME

(71) Applicant: Modine Manufacturing Company, Racine, WI (US)

(72) Inventors: Timothy Carlson, Mt Pleasant, WI (US); Jacob Rivard, New Berlin, WI (US); Frances Kis, Yorkville, WI (US); Bradley Engel, Waterford, WI (US)

(73) Assignee: MODINE MANUFACTURING COMPANY, Racine, WI (US)

( * ) Notice: Subject to any disclaimer, the term of this patent is extended or adjusted under 35 U.S.C. 154(b) by 35 days.

(21) Appl. No.: 15/687,873

(22) Filed: Aug. 28, 2017

(65) Prior Publication Data

US 2018/0066901 A1 Mar. 8, 2018

Related U.S. Application Data

(60) Provisional application No. 62/382,900, filed on Sep. 2, 2016.

(51) Int. Cl.
*B23P 15/26* (2006.01)
*F28F 9/02* (2006.01)
(Continued)

(52) U.S. Cl.
CPC ..... *F28F 9/0243* (2013.01); *F28D 1/05366* (2013.01); *F28F 9/001* (2013.01);
(Continued)

(58) Field of Classification Search
CPC ..... F28F 9/0243; F28F 9/0256; F28F 9/18; F28F 9/001; F28F 9/0248; F28F 9/002;
(Continued)

(56) References Cited

U.S. PATENT DOCUMENTS 2,972,186 A 2/1961 Howe
3,307,622 A 3/1967 Oddy
(Continued)

FOREIGN PATENT DOCUMENTS

DE 19524052 A1 1/1997
EP 1544532 A1 6/2005
EP 1729080 A1 12/2006

OTHER PUBLICATIONS

Notification of the Second Office Action for Application No. 201710780943.4, National Intellectual Property Administration of the People's Republic of China dated Jun. 27, 2019 (10 pages).
(Continued)

*Primary Examiner* — Jun S Yoo
(74) *Attorney, Agent, or Firm* — Michael Best & Friedrich LLP; Jeroen Valensa; Michael Bergnach

(57) ABSTRACT

A header for a heat exchanger includes a first and a second cylindrical portion. The first cylindrical portion has a first diameter, and extends over a first length portion of the header. The second cylindrical portion has a second diameter that is smaller than the first diameter, and extends over a second length portion of the header. Tube receiving slots are arranged along the first length portion. An end cap is received into an open end of the first cylindrical portion, and is joined thereto to seal a first end of the header. An open end of the second cylindrical portion is arranged at a second end of the header opposite the first end to allow for fluid flow into or out of the header. A circumferential bead is located between the first and second cylindrical portions, and extends radially outward of the first cylindrical portion.

7 Claims, 6 Drawing Sheets

(51) Int. Cl.
*F28D 1/053* (2006.01)
*F28F 9/00* (2006.01)
*F28F 9/18* (2006.01)

(52) U.S. Cl.
CPC ..... *F28F 9/18* (2013.01); *F28F 2009/0297* (2013.01); *F28F 2275/085* (2013.01)

(58) Field of Classification Search
CPC ..... F28F 2280/06; F28F 2275/085; F28F 2009/0297; B21D 41/04; B21D 17/025; B21D 53/02; B21D 26/045; B21D 53/06; B21D 28/28; B21D 28/34; B21D 28/343; B21D 39/04; B21D 39/06; B21D 53/04; B21D 53/085; F28D 1/0535; F28D 1/05366; F28D 1/05316; F28D 1/05383; B28D 1/05333; B23P 15/26
See application file for complete search history.

(56) References Cited

U.S. PATENT DOCUMENTS 4,258,785 A 3/1981 Beldam
5,052,478 A * 10/1991 Nakajima ..... F28F 9/0212 165/153
5,183,103 A 2/1993 Tokutake
5,379,834 A 1/1995 Tokutake
5,737,952 A * 4/1998 Baumann ..... B21D 26/045 72/325
5,810,054 A * 9/1998 Goulet ..... F16L 37/02 138/109
5,829,133 A * 11/1998 Joshi ..... F28F 9/0243 29/890.043
5,868,198 A * 2/1999 Kato ..... B21D 53/04 165/153
5,898,996 A * 5/1999 Buchanan ..... B21D 28/28 29/890.052
5,899,263 A 5/1999 Tokutake
6,059,019 A 5/2000 Brost et al.
6,158,500 A 12/2000 Heine
6,273,182 B1 8/2001 Pautler et al.
6,382,312 B2 5/2002 Avequin et al.
6,615,604 B2 9/2003 Neufang
6,848,723 B2 2/2005 Lamich
6,901,992 B2 6/2005 Kent et al.
7,287,574 B2 10/2007 Desai et al.
7,552,757 B2 6/2009 Hassdenteufel et al.
9,261,011 B2 2/2016 Keerl
2010/0071635 A1 3/2010 Moore et al.
2012/0043754 A1 2/2012 Gadawski

OTHER PUBLICATIONS

European Search Report and Opinion for Application No. 17001074.8 dated Jan. 25, 2018 (6 pages).
Notification of First Office Action for Application No. 201710780943.4, The State Intellectual Property Office of the People's Republic of China dated Jan. 16, 2019 (11 pages).

* cited by examiner

HEADER FOR A HEAT EXCHANGER, AND METHOD OF MAKING THE SAME

CROSS-REFERENCE TO RELATED APPLICATIONS

This application claims priority to U.S. provisional patent application No. 62/382,900, filed on Sep. 2, 2016, the entire contents of which are hereby incorporated by reference in their entirety.

FIELD OF THE INVENTION

The invention relates to heat exchangers of a tube and fin construction, headers for such heat exchangers, and methods of making such headers.

BACKGROUND

Heat exchangers of a tube and fin construction, having an array of flat tubes extending between spaced apart headers with fins arranged between adjacent ones of the tubes, are known in the art. The tubes, fins, and headers are often fabricated from a brazeable metal such as aluminum and joined together in a brazing process.

In some well-known heat exchangers of this type, for example radiators commonly used in vehicular applications, a tank is created at each header by joining a formed component (for example, an injection-molded plastic part) to the header, thereby creating a fluid volume at each end of the array of flat tubes to distribute a fluid to be heated or cooled to one end of each tube and to receive that fluid at the opposing end of the tube. Such a formed component is typically joined to the header after brazing, for example by crimping a periphery of the header to the formed component along with an gasket seal. One advantage of such a construction is that a variety of features, including fluid inlet and/or outlet ports and mounting features, can be integrated directly into the formed component at little or no additional cost. However, these cost savings can be more than offset by the additional cost and complexity associated with the secondary joining operation after brazing.

In some other well-known heat exchangers of this type, for example condensers commonly used in vehicle applications, the header is of a cylindrical shape and includes the aforementioned tank, so that such secondary joining operations can be avoided. However, the benefits of directly integrated fluid ports and mounting features can also be lost thereby, or might require additional parts that need to be joined to the heat exchanger either during or after brazing. This can also further increase the cost and complexity associated with manufacturing the heat exchanger.

SUMMARY

According to one embodiment of the invention, a header for a heat exchanger includes a first and a second cylindrical portion. The first cylindrical portion has a first diameter, and extends over a first length portion of the header. The second cylindrical portion has a second diameter that is smaller than the first diameter, and extends over a second length portion of the header. Tube receiving slots are arranged along the first length portion. An end cap is received into an open end of the first cylindrical portion, and is joined thereto to seal a first end of the header. An open end of the second cylindrical portion is arranged at a second end of the header opposite the first end to allow for fluid flow into or out of the header. A circumferential bead is located between the first and second cylindrical portions, and extends radially outward of the first cylindrical portion.

In some embodiments at least one of the tube slots is located a distance no greater than one and a half times the first diameter from the circumferential bead. In some embodiments at least one of the tube slots is located a distance no greater than forty millimeters from the circumferential bead.

In some embodiments, a heat exchanger having two such headers is part of a cooling module. The cooling module includes a frame to which the heat exchanger is secured. The frame has one or more retention features that securely restrain a first one of the headers. The cooling module also includes an attachment bracket that is removably joined to the frame. The attachment bracket securely restrains the second header. By securely restrained, it is meant that movement of the headers relative to the frame, other than small displacements due to vibrations and the like, are prevented.

In some such embodiments, the one or more retention features include a concave cylindrical surface against which the first cylindrical portion of the first header is disposed, a floor portion against which the first end of the first header is disposed, and a notch that receives the circumferential bead of the first header. In some such embodiments, the attachment bracket includes a concave cylindrical surface against which the first cylindrical portion of the second header is disposed, a floor portion against which the first end of the second header is disposed, and a notch that receives the circumferential bead of the second header.

In some embodiments the one or more retention features securely restrain the first header at least in part by engaging the circumferential bead of the first header. The attachment bracket securely restrains the second header at least in part by engaging the circumferential bead of the second header.

In some embodiments the one or more retention features of the frame and the attachment bracket cooperate to substantially prevent movement of the heat exchanger relative to the frame. Movement of the heat exchanger relative to the frame is substantially prevented when free-body displacement of the heat exchanger relative to the frame is prevented in all directions; however, small movements due to thermal expansion, vibrations, slight deformations, and the like may still occur.

In some embodiments the attachment bracket is removably joined to the frame by way of at least one snap feature provided on the frame or on the attachment bracket. In some such embodiments, snap features are provided on both the frame and the attachment bracket. In some such embodiments the heat exchanger is rotatable about an axis defined by the first cylindrical portion of the first header when the at least one snap feature is disengaged. In some other embodiments the attachment bracket is removably joined to the frame by way of fasteners, and the heat exchanger is rotatable about that axis when the fasteners are removed.

According to another embodiment of the invention, a method of making a header for a heat exchanger includes the steps of forming a cylindrical tube from a sheet of aluminum material, piercing tube receiving slots through a wall of the tube, forming a circumferential bead into the tube, and reducing in diameter a portion of the tube between the circumferential bead and an open end of the tube. An end cap is inserted into a second open end of the tube. In some embodiments a hose bead is formed into the first open end.

In some embodiments, the step of piercing tube slots includes clamping an outer surface of the tube in a die, internally pressurizing the tube with a fluid, and then displacing punches in a radially inward direction of the tube to pierce through the wall. In some such embodiments the piercing forms inwardly directed flanges around each slot.

In some embodiments, piercing the slots is done before the circumferential bead s formed and before the diameter is reduced.

In some embodiments, the circumferential bead is formed by clamping a portion of the tube in a die with a clamping force that is sufficient to resist axial displacement of the tube during the forming operation. An axial force is then applied to the tube at the open end, and a portion of the tube wall is forced into a recess that is provided within the die. The recess can be provided at a location that is immediately adjacent to the portion of the tube that is being clamped. One or more of the slots can be located within the portion of the tube that is clamped. In some such embodiments, protrusions extend from the die into slots located within the clamped portion.

In some embodiments the step of reducing the diameter of the tube includes placing the tube in a die so that a surface of the bead that is located furthest from the first open end is disposed against a surface of the die. A ram is moved towards the die from that open end, and a portion of the tube between that end and the bead is forced into an annular groove of the ram. A resistive force is applied to the bead in order to prvent axial movement of the tube while moving the ram towards the die.

DETAILED DESCRIPTION

Before any embodiments of the invention are explained in detail, it is to be understood that the invention is not limited in its application to the details of construction and the arrangement of components set forth in the following description or illustrated in the accompanying drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
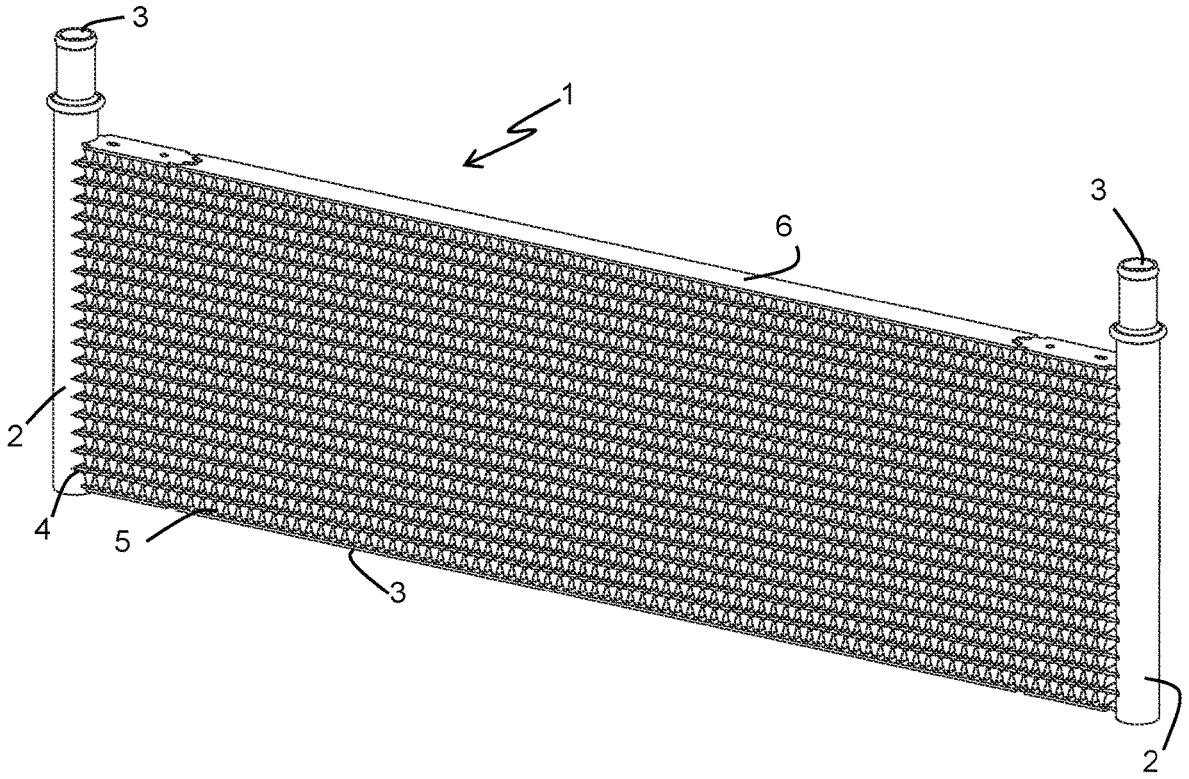
FIG. 1 is a perspective view of a heat exchanger having a pair of headers according to an embodiment of the invention.
Figure 2:
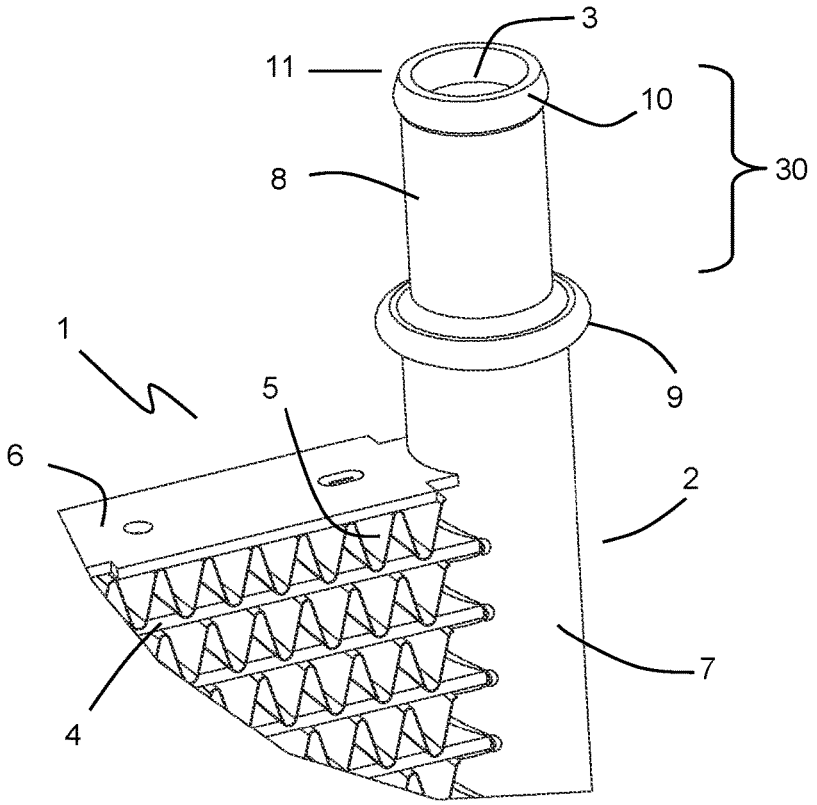
FIG. 2 is a perspective view of a portion of the heat exchanger of FIG. 1.
Figure 3:
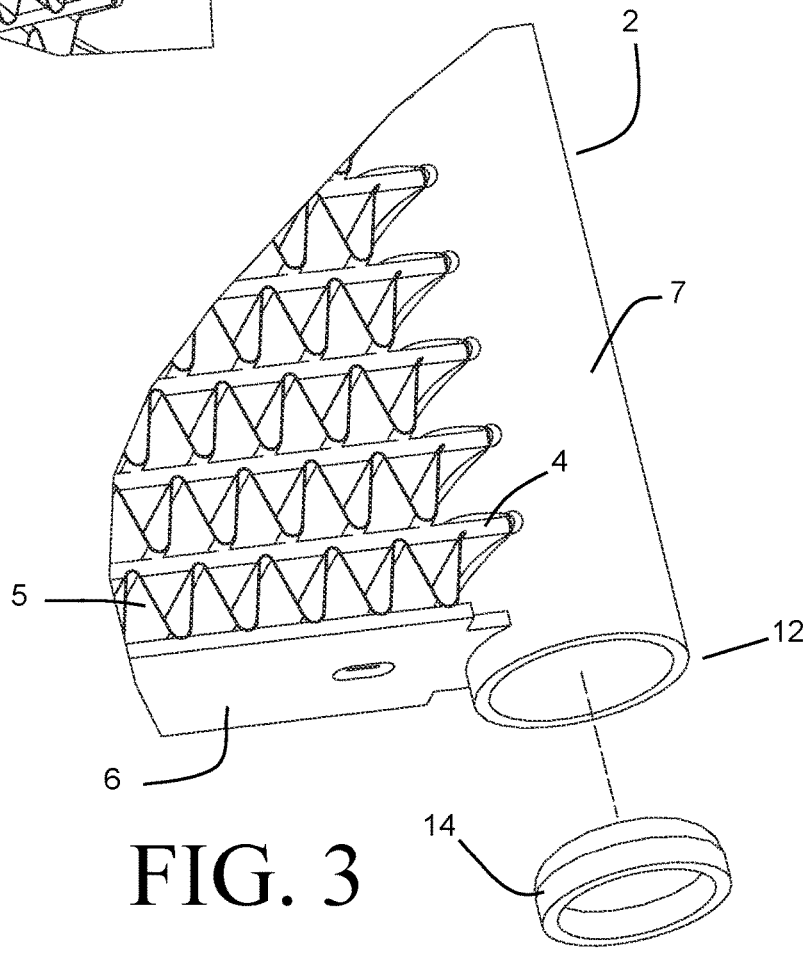
FIG. 3 is a partially exploded perspective view of another portion of the heat exchanger of FIG. 1.

A heat exchanger 1 including a pair of headers 2 according to one embodiment of the invention is depicted in FIGS. 1-3. Such a heat exchanger 1 can find particular utility in motor vehicle applications as a radiator, an oil cooler, or other type of heat exchanger used to heat or cool a fluid by the transfer of heat between the fluid and air that is directed through the heat exchanger. In one particular application to which the heat exchanger 1 is especially well-suited, the heat exchanger 1 operates as a radiator within an electric vehicle to reject heat from a flow of coolant used to extract heat from the electrical powertrain, e.g. from electric motors, inverters, batteries, and the like.

The heat exchanger 1 is constructed with a stacked array of flat tubes 4 and serpentine fins 5 in alternating arrangement. The flat tubes 4 can, by way of example, be fabricated tubes formed from one or more flat strips of metal material or be produced as extruded shapes. The fins 5 can be formed from thin sheets of metal material, and can be provided with surface augmentation features such as lances, louvers, or the like (not shown) in order to improve the rate of convective heat transfer between the fin surface and the air passing over the fins. In some highly preferable embodiments the fins and the tubes 4 are both formed of aluminum material and a braze alloy cladding is present on the surfaces of the fins 5 or the tubes 4 or both, so that the array of tubes and fins can be metallurgically joined into a monolithic structure by brazing the heat exchanger 1 in a braze furnace.

The heat exchanger 1 further includes a pair of headers 2 arranged at either end of the array of fins 5 and tubes 4. Each header 2 has a cylindrical portion 7 extending over a length portion 33 of the header (best seen in FIG. 5D). The cylindrical portion 7 has a generally constant diameter. Tube receiving slots 16 are provided at regularly spaced intervals over at least part of the length portion 33 in one-to-one correspondence to the tubes 4.

Also provided in the heat exchanger 1 are a pair of side plates 6 arranged adjacent to the outermost ones of the fins 5. During assembly of the heat exchanger 1, and prior to brazing, the stacked arrangement of tubes 4 and fins 5 is compressed between the side plates 6. While the tubes 4 and fins 5 are in this compressed state, the headers 2 can be assembled by receiving the ends of the tubes 4 into the slots 16 of the headers 2. The completed assembly can then be brazed in a brazing furnace to create the desired braze joints between the fins 5 and the tubes 4, as well as between the outermost ones of the fins 5 and the side plates 6, between the tubes 4 and the headers 2, and (optionally) between the side plates 6 and the headers 2.

The headers 2 will now be described in further detail, with particular reference to FIGS. 2 and 3. In the exemplary embodiment shown in the figures, the two headers 2 are identical parts, and consequently only a single one of the headers 2 will be described. It should be understood, however, that in some embodiments it may be preferable to employ the described header 2 at only one end of the heat exchanger 1, and to have the opposing header constructed in a different fashion and/or with different features.

At one end 12 of the header 2, shown in detail in FIG. 3, a formed end cap 14 is received into an opening 13 of the header 2. The length portion 33 of the cylindrical portion 7 extends to the end 12. The end cap 14, shown in a pre-assembled state, is inserted into the opening 13 such that the end of the end cap 14 is generally flush with the end 12 of the header 2. The diameter of the end cap 14 is preferably sized so that a tight fit is achieved between the cylindrical outer surface of the end cap 14 and the cylindrical inner surface of the header 2. The end cap 14 is preferably formed from an aluminum material having a clad layer of braze alloy present on those outer cylindrical surfaces, so that the end cap 14 can be assembled to the heat exchanger 1 prior to the brazing operation such that the end cap 14 will be brazed to the header during the brazing operation, thereby creating a leak-tight seal of the header 2 at the end 12. In some alternative embodiments the end cap can instead be joined to the cylindrical outer surface of the header 2 and/or to the end 12 itself.

At the opposing end of the header 2, shown in detail in FIG. 2, another cylindrical portion 8 is provided and extends over a length portion 30 of the header 2. The cylindrical portion 8 is coaxial with the cylindrical portion 7, and has a diameter that is smaller than the diameter of the cylindrical portion 7. An opening 3 is provided at an end 11 of the header 2 opposite the end 12. The open end 11 allows for the fluid that is to be heated or cooled by the air to flow into the header 2 (in the case where the header 2 is an inlet header of the heat exchanger 1) or out of the header 2 (in the case where the header 2 is an outlet header of the heat exchanger 1) to be distributed to or from the tubes 4. A hose bead 10 is optionally provided at the end 11, allowing for improved retention of a hose to supply or receive the fluid to or from the heat exchanger 1. Such a hose can, for example, be secured to the header 2 by way of a band that encircles the hose at a location along the cylindrical portion 8 and compresses the hose against the header 2 at that location, with the hose bead 10 preventing the band from sliding off of the header 2 at the end 11.

A circumferential bead 9 is provided between the first cylindrical portion 7 and the second cylindrical portion 8 and serves as a division between the first length portion 33 and the second length portion 30. The circumferential bead 9 extends radially outward of the cylindrical portion 7. In some especially preferential embodiments, the circumferential bead 9 is formed within a relatively close distance from a nearest one of the tube receiving slots 16. In some such embodiments, the circumferential bead 9 is located no more than forty millimeters from the nearest tube receiving slot 16. In other such embodiments the circumferential bead 9 is located within a distance that is one and a half times the diameter of the cylindrical portion 7 from the nearest tube receiving slot 16. The first cylindrical portion 7, second cylindrical portion 8, circumferential bead 9, and the optional hose bead 10 are all formed as a single unitary piece, as will be described.

The header 2 can be formed in a series of sequentially performed operations. In a first operation, a cylindrical tube 15 of constant diameter is roll-formed from a sheet of aluminum material and is cut to a predetermined length to define the ends 11 and 12. Such a roll forming operation typically includes feeding a continuous sheet of flat material of a predefined width through a series of rollers to deform the flat sheet into a cylindrical shape. Once the cylindrical shape is achieved, a longitudinal seam where the ends of the sheet (in the width direction) meet is created by a welding operation. The completed cylindrical tube 15 is subsequently cut to length by, for example, a cut-off saw operation.

Figure 9A:
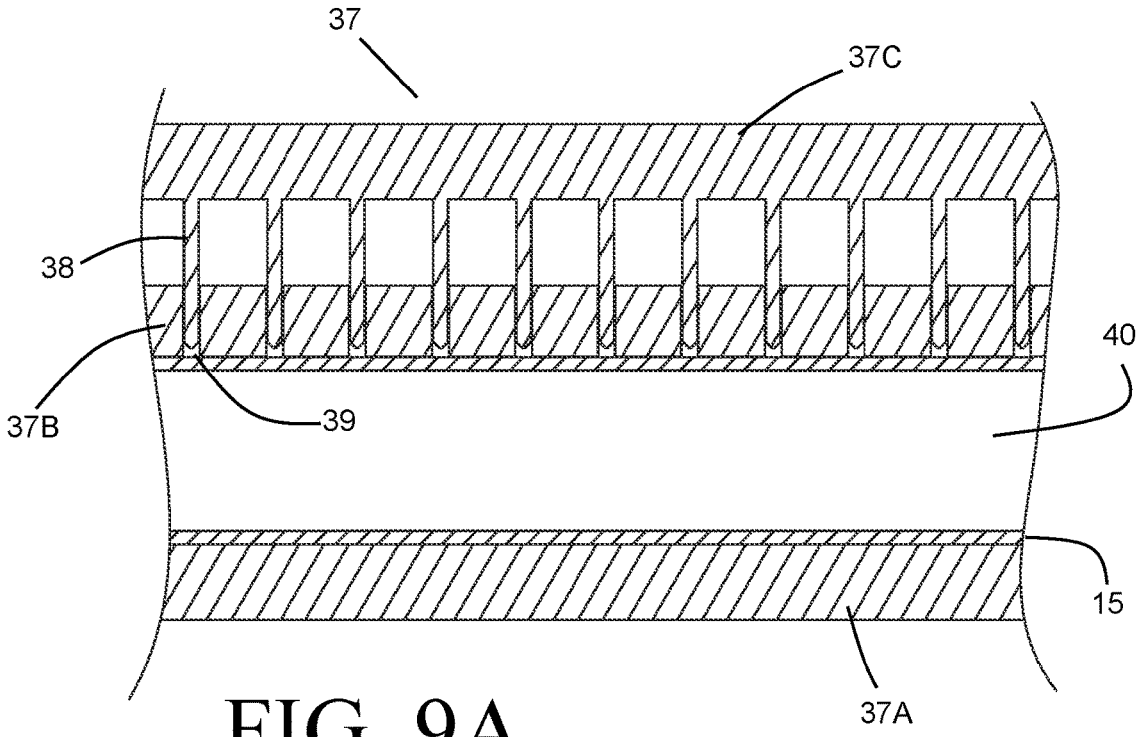
Figure 9B:
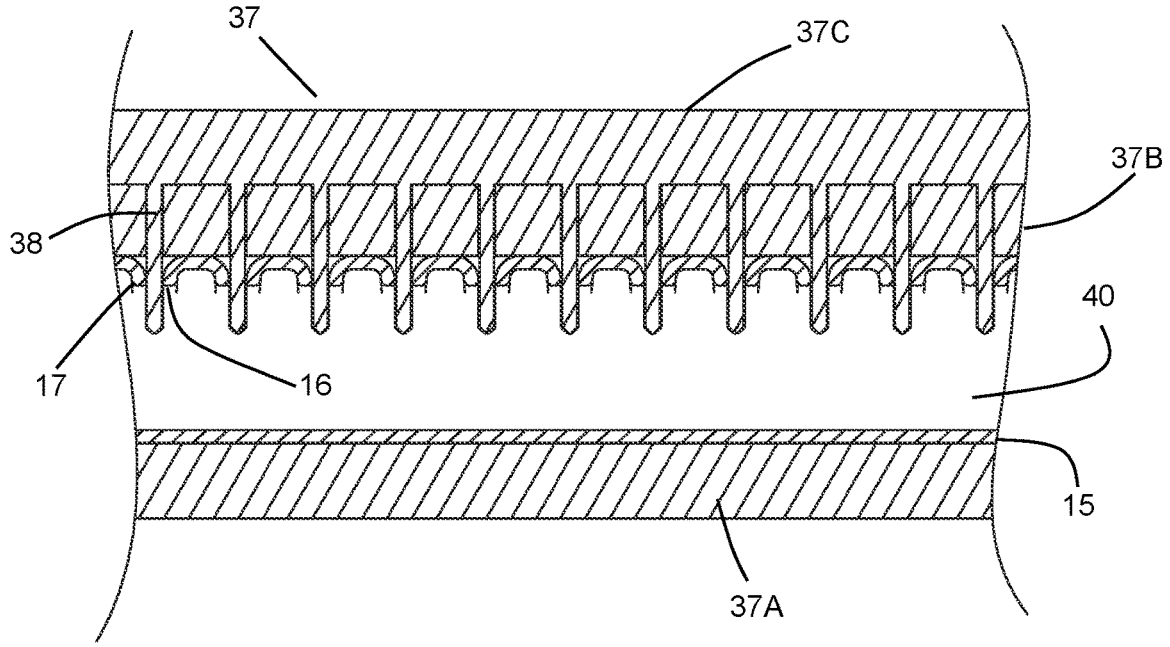

After the cylindrical tube 15 has been formed, the tube receiving slots 16 are created, preferably by a piercing operation as depicted in FIGS. 9A and 9B. The cylindrical tube 15 is tightly held within a die, between a lower die part 37A and an upper die part 37B. It should be noted that the die parts 37A and 37B are referred to as a lower die part and an upper die part, respectively, solely to aid in the description of the process, and that in application the die parts may be oriented differently. The upper die part 37B is provided with a series of slots 39, which accommodate punches 38 that are provided as part of a movable die part 37C. The movable die part 37C is displaced towards the upper die part 37B, i.e. in a direction that is radially inward relative to the tube 15. The displacement of the movable die part 37C causes the punches 38 to pierce through the wall of the tube 15, thereby forming both the tube slots 16 and inwardly directed flanges 17 surrounding each one of the tube slots 16. These flanges 17 provided increased strength for the tube 15, as well as providing additional brazing area for the connection of the flat tubes 4 to the header 2.

In order to resist the substantial forces imposed on the tube wall by the piercing operation, and to prevent buckling or other undesirable deformation of the tube wall, it is preferable to reinforce the tube wall during the piercing operation. Such reinforcement can be achieved by filling the inner volume 40 of the tube 15 with a fluid such as, for example, an oil, and pressurizing that fluid to provide radially outwardly directed pressure forces on the inner surfaces of the tube wall in order to resist the inwardly directed forces associated with the piercing operation. Alternatively, an internal mandrill can be provided within the volume 40 and can bear against the inner surfaces of the tube wall, with appropriate relief features provided within the mandrill to accommodate both the punches 38 and the formed flanges 17.

Figure 5A:
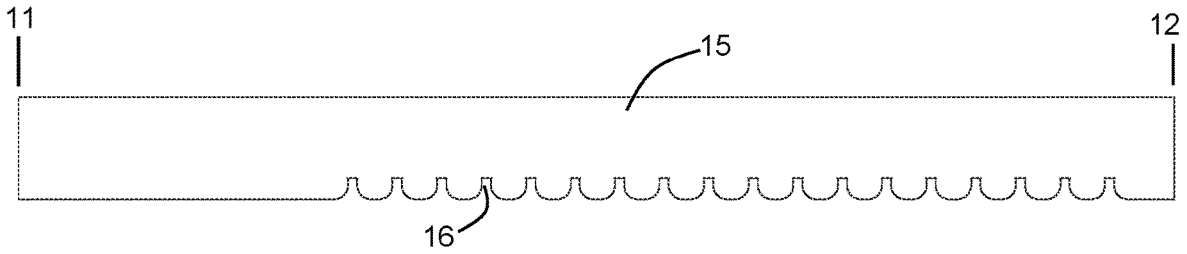
FIGS. 5A-D are plan views of a header of the heat exchanger of FIG. 1 in various stages of production.
Figure 5B:
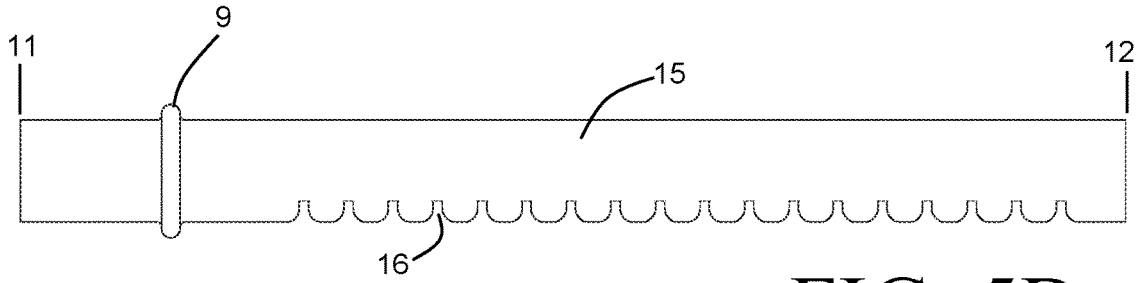
Figure 5C:
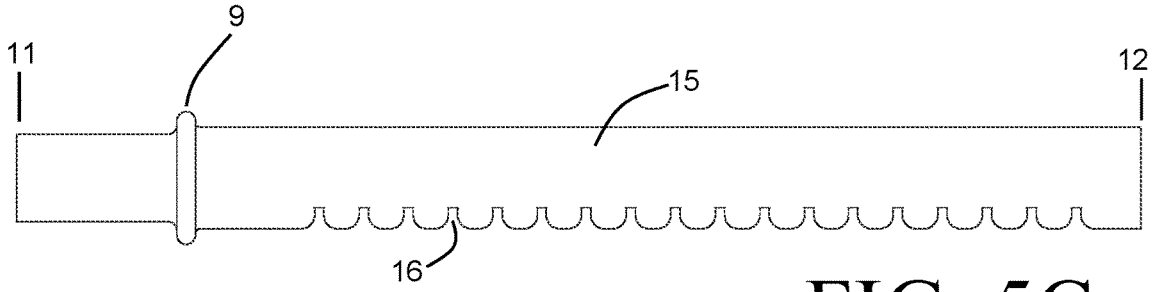
Figure 5D:
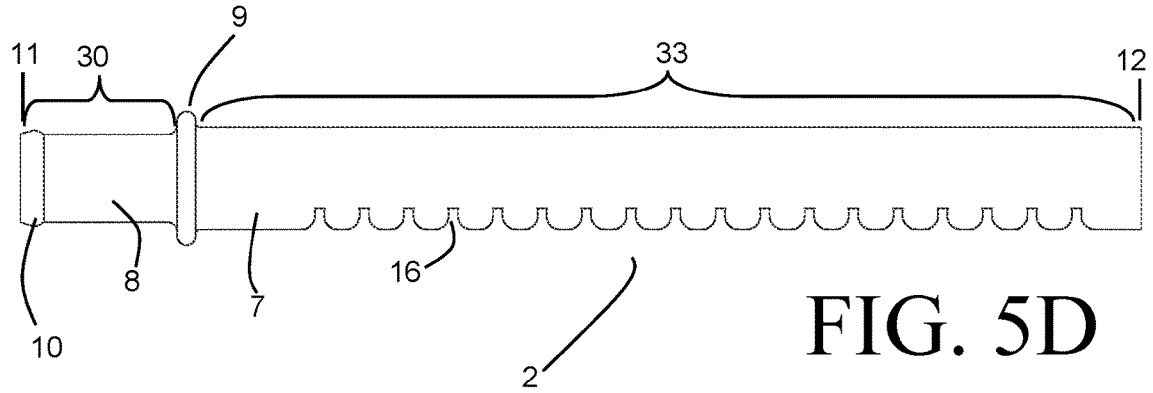

The tube 15 after the piercing of the tube slots 16 is depicted in FIG. 5A. As shown in that figure, the tube slots 16 are provided over only a portion of the complete length of the tube 15, with an end portion extending from the end 11 being free of slots 16. A series of forming operations are performed on the tube 15 in order to produce the completed header 2. FIGS. 5B, 5C and 5D depict the tube 15 after successive ones of the aforementioned forming operations.

Figure 6A:
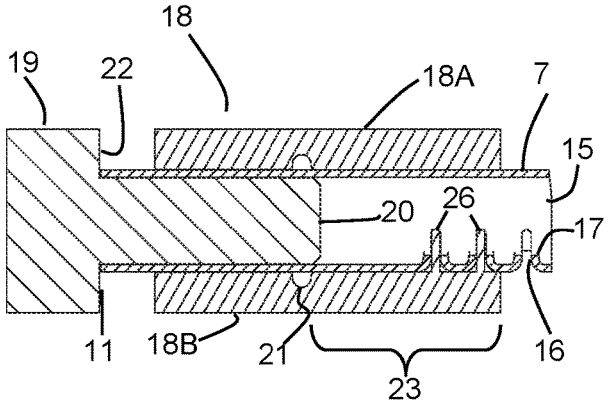
FIGS. 6A-B, 7A-B, 8A-B, and 9A-B are partial sectional views showing various manufacturing steps for producing a header according to an embodiment of the invention.
Figure 6B:
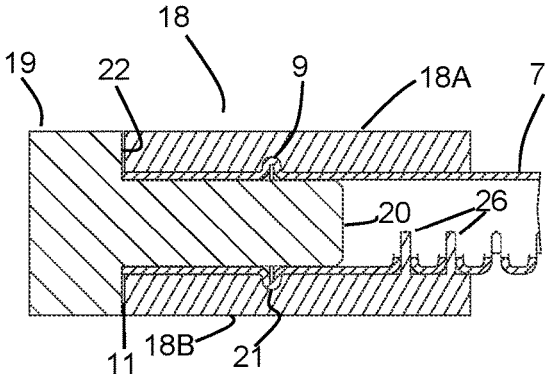

The circumferential bead 9 is formed into the tube 15 in a forming operation depicted in FIGS. 6A and 6B, to produce the tube 15 as shown in FIG. 5B. FIG. 6A depicts a pre-forming stage of the forming operation, while FIG. 6B shows a post-forming stage of the operation. In the pre-forming stage, at least a portion of the tube 15 adjacent the end 11 is placed within a clamping die 18. The clamping die 18 can include two or more parts (two parts 18A, 18B are depicted) that together provide a cylindrical internal profile generally matching the cylindrical profile of the tube 15 (which is equivalent to the cylindrical portion 7 of the finished header 2). A circumferential recess 21 is provided within the die 18 to provide a space for displaced tube wall material to be gathered.

During the pre-forming stage, the die parts 18A, 18B close around the tube 15. The cylindrical inner surface of the die parts 18A, 18B is preferably not of a constant diameter, instead having a slightly smaller diameter in the region 23 arranged on one side of the circumferential recess 21, that region 23 being the portion of the die 18 that is furthest from the end 11 of the tube 15 when the tube 15 is placed within the die 18. The inner surface of the die 18 in the region 23 is sized so that, when the die 18 is closed around the tube 15, that portion of the tube 15 that is located long the region 23 is securely clamped by the die 18. In contrast, that portion of the tube 15 which is arranged in the die 18 on the opposite side of the circumferential recess 21 is not clamped due to a slight clearance between the tube 15 and the inner surfaces of the die 18 in that area.

A movable ram 19 translates along the axial direction of the tube 15, and includes a core portion 20 that inserts within, and freely slides within, the tube 15. The core portion extends from a planar face 22, which is disposed against the end 11 of the tube 15 in the per-forming stage shown in FIG. 6A. Preferably, the core portion 20 extends to the circumferential recess 21 when the planar face 22 is disposed against the end 11. The tube 15 after the forming of the circumferential bead 9 is depicted in FIG. 5B.

During the forming stage the movable ram displaces further along the axial direction of the tube 15, thereby axially compressing the tube 15 and causing the tube wall to buckle into the circumferential recess 21 in order to form the circumferential bead 9 in the tube wall. Displacement of the tube wall in the clamped region 23 is prevented due to the clamping force of the die 18 in that region, whereas the tube wall material located between the end 11 and the circumferential recess 21 is allowed to displace as a result of the force imposed by the moving ram 19. Undesirable inward buckling of the tube wall in that area is prevented by the presence of the core portion 20 of the ram 19.

The clamping force required in the region 23 to prevent axial movement of the tube 15 itself in response to the forces applied by the ram 19 during the forming process can be substantial, requiring both a minimum clamping pressure and a minimum length over which that pressure is to be applied. It is highly desirable for the heat exchanger 1 to have a compact shape so that the packaging requirements of heat exchanger within the end system can be met. As a result, one or more of the slots 16 may need to be placed sufficiently close to the circumferential bead as to be located within the clamping region 23. In some preferable embodiments, the slot 16 that is located closest to the circumferential bead 9 is no more than one and a half times the diameter of the tube 15 away from the circumferential bead 9, or no more than forty millimeters, or both. The required clamping length 23 is frequently greater than that, so that one or more of the slots 16 are located within the portion of the tube 15 being clamped. In the exemplary embodiment of FIGS. 6A-B, two slots 16 are so located.

It is highly desirable that distortion of the tube slots 16 within the clamped region 23 by the required clamping force is prevented, so that sufficiently durable and leak-free braze joints between the flat tubes 4 and the header 2 at those tube slots 16 can be achieved. In order to prevent such distortion, the die part 18B is provided with protrusions 26 that are received into those tube slots 16 that are within the clamped region 23. The protrusions 26 are of a similar profile as the flat tubes 4, and consequently ensure that the shapes of the tube slots 16 and the flanges 17 are not distorted by the forming operation.

Figure 7A:
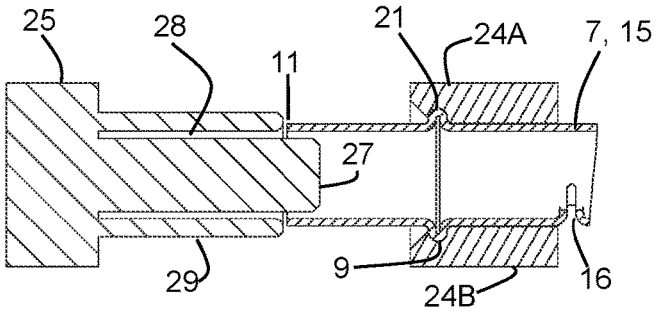
Figure 7B:
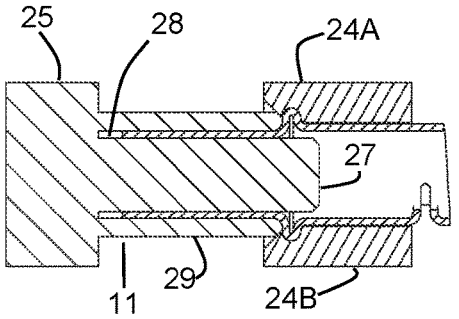

The cylindrical portion 8 is resized in a subsequent ram-reduction forming operation, depicted in FIGS. 7A and 7B, to have a smaller diameter than the cylindrical portion 7. FIG. 7A depicts a pre-forming stage of the ram-reduction operation, while FIG. 6B shows a post-forming stage of the operation. In the pre-forming stage, a portion of the tube 15 located immediately adjacent to the circumferential bead 9 is held in a clamping die 24 (shown having two parts, 24A and 24B).

During the ram reduction forming, a movable ram 25 translates along the axial direction of the tube 15. The movable ram 25 includes ring portion 29 that surrounds a core portion 27 so that an annular space 28 is defined therebetween. Both the core portion 27 and the ring portion 29 are cylindrical in shape and are coaxial with the tube 15. The inner diameter of the ring portion 28 is equal in diameter to the cylindrical portion 8, which is smaller in diameter than the tube 15. The annular gap 28 is approximately equal, in the radial dimension, to the wall thickness of the tube 15. As the ram 25 moves towards the die 24, the core portion 27 is received into the tube 15 and the tube wall adjacent the end 11 is forced into the annular gap 28. The forward stroke of the ram 25 is complete, in the exemplary embodiment, when the entirety of the cylindrical tube wall between the end 11 and the circumferential bead 9 has been reformed. However, in some alternative embodiments it may be equally or more desirable to form less than the entirety of that tube wall length. Depending on the amount of diameter reduction that is desired, multiple stages of such ram reduction may be necessary or desirable. The tube 15 after the forming of the circumferential bead 9 is depicted in FIG. 5C.

Unlike the clamping die 18, the cylindrical inner surface of the clamping die 24 need not clamp onto the cylindrical diameter of the tube 15 in order to secure the tube 15 during the forming. Rather, the die 24 can be provided with a circumferential recess 21 that closely accommodates the circumferential bead 9 of the tube 15. The recess 21, having a partial torus shape, can engage the bead 9 to prevent axial displacement of the tube 15 during both the forward stroke and the reverse stroke of a ram 25. Specifically, a surface of the circumferential bead that is furthest from the end 11 (i.e. facing the end 12) bears against a corresponding surface of the circumferential recess 21 while axial force is applied to the end 11, thereby preventing movement of the tube 15. Similarly, during withdrawal of the movable ram 25 from the tube 15, a surface of the circumferential bead 9 that is nearest to the end 11 bears against another corresponding surface of the circumferential recess 21 so that the movable ram 25 is stripped from the tube 15. As a result, the length of the die 24 can potentially be reduced from that of the die 18 of the previous forming operation so that all of the slots 16 are outside of the die 24, as shown in the exemplary embodiment.

Figure 8A:
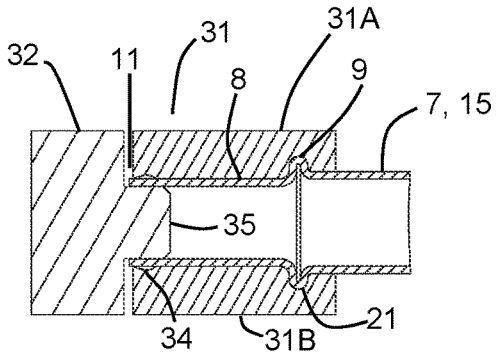
Figure 8B:
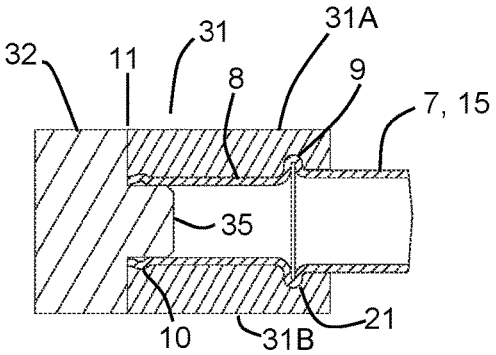

Optional additional forming operations can subsequently be performed on the cylindrical portion 8 in a similar manner. By way of example, a hose bead forming operation at the end 11 is shown in FIGS. 8A and 8B, with FIG. 8A depicting a pre-forming stage of the operation and FIG. 8B showing a post-forming stage of the operation. In the pre-forming stage, the end portion of the tube 15 is arranged within a clamping die 31 (shown having two parts, 31A and 31B). Since the material displacement operation is limited to the very end of the tube 15, the majority of the tube portion 8 can be received in the die 31, thus requiring very little of the cylindrical portion 7 to be arranged within the die 31. A movable ram 32 translates along the axial direction of the tube 15 during this forming operation, and displaces the tube material at the end 11 of the tube 15 into a contoured recess 34 provided within the die 31 to create a hose bead 10. A core portion 35 of the ram 32 is provided and traverses within the internal volume of the cylindrical portion 8 in order to prevent the tube wall material from deforming inwardly.

Similar to die 24, the die 31 is also provided with a circumferential recess 21 to receive and accommodate the circumferential bead 9 of the tube 15. The recess 21 can provide the necessary resistance to the forces applied to the end 11 of the tube during the forming operation, thereby avoiding the need to clamp directly onto the cylindrical portion 8. In other words, a slight clearance between the inner surfaces of the die 31 at the cylindrical portion 8 of the tube 15 and the tube wall material itself can be provided, so that any undesirable distortion of the cylindrical portion 8 can be avoided. The completed header 2 including the hose bead 10 is depicted in FIG. 5D.

The provision of the circumferential bead 9 within the header 2 provides particular advantages during the forming operations described. The partial torus shape of bead 9 is able to provide substantial resistance to the axial forces imposed during the subsequent forming operations, especially the diameter reducing operation of FIGS. 7A and 7B. These forces are typically greater than the forces that must be resisted during the forming of the circumferential bead 9 itself. By first forming the circumferential bead 9 into the tube 15, the need to clamp directly onto the cylindrical portion 7 of the tube 15 is avoided. Consequently, the risk of distorting the tube slots 16 during the diameter reduction process is avoided.

Figure 4:
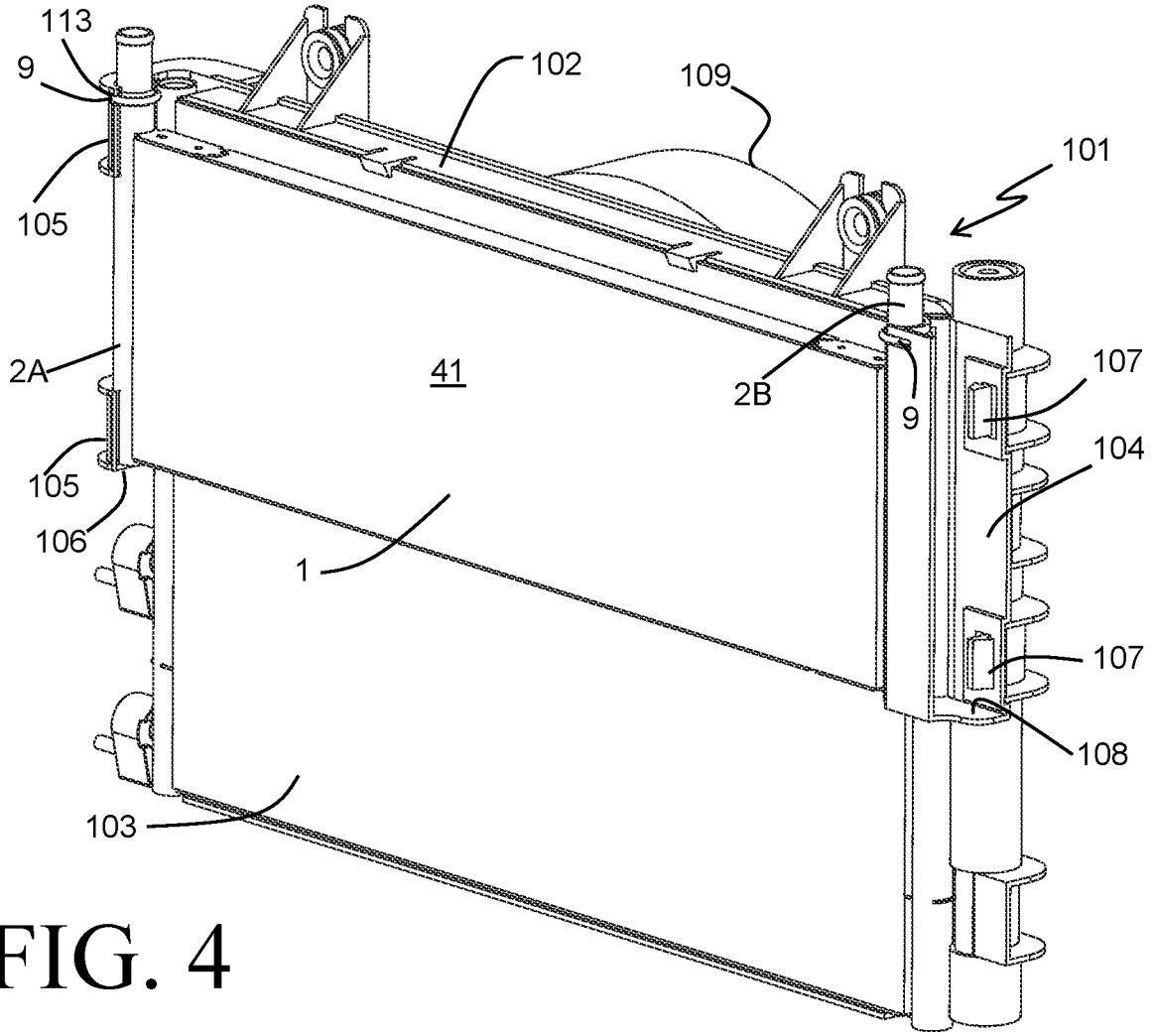
FIG. 4 is a perspective view of a cooling module including the heat exchanger of FIG. 1.

The circumferential bead 9 can provide further advantages during assembly of the heat exchanger into a module 101, as depicted in FIG. 4. The exemplary module 101 is a cooling module for an electric vehicle, and includes both the heat exchanger 1 (for example, as a radiator to cool liquid coolant) and a condenser 103. Additional heat exchangers may also be present in the module 101, but are not shown. The heat exchangers 1, 103 are arranged within a plastic frame 102 to secure them within the vehicle. A fan 109 can further be housed within the frame 102 in order to direct air through the heat exchangers 1, 103.

In order to secure the heat exchanger 1 within the frame 102, one or more retention features 105 (two are shown in FIG. 4) are provided as part of the frame 102. The one or more retention features 105 are arranged along the length portion 33 of a header 2A of the heat exchanger 1, and include a concave cylindrical surface that corresponds to the diameter of the cylindrical portion 7 of the header 2A. Preferably the concave cylindrical surface extends over a substantial part of the circumference of the cylindrical portion 7. In some preferable embodiments, such as the exemplary embodiment of FIG. 4, the concave cylindrical surface extends over approximately a 180° angle, so that effectively about half of the circumference of the header 2A at the locations corresponding to the one or more retention features 105 engages the features.

Figure 10:
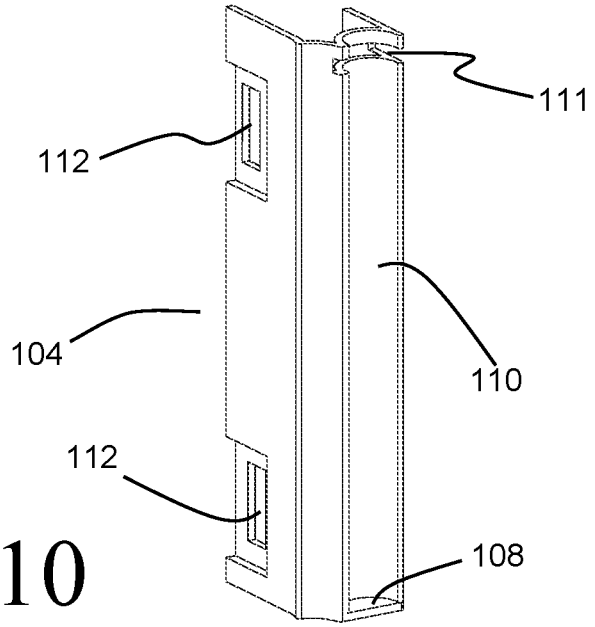
FIG. 10 is a perspective view of a component of the module of FIG. 4.

At the opposing header 2B, a separate attachment bracket 104 is provided. The attachment bracket 104 is, in some preferable embodiments, formed as an injection molded plastic part as shown in FIG. 10. A concave cylindrical surface 110 provided in the attachment bracket 104 corresponds to the cylindrical portion 7 of the header 2B. In a similar fashion to that described with respect to the concave cylindrical surfaces of the retention features 105, the concave cylindrical surface 110 extends over a substantial part of the circumference of the cylindrical portion 7, for example approximately 180°. In this manner, the one or more retention features 105 and the attachment bracket 104 can cooperate so that movement of the heat exchanger 1 relative to the frame 102 in both the axial direction of the flat tubes 4 and in a direction normal to the face 41 of the heat exchanger 1 is prevented.

A floor portion 106 is provided in a lowermost one of the retention features 105, and the end 12 of the header 2A is disposed against the floor portion 106. A notch 113 is provided in an uppermost one of the retention features 105 and receives the circumferential bead 9 of the header 2A therein. It should be observed that in some embodiments a single retention feature 105 spanning the entire length portion 33 of the header 2A can be provided, such that the single retention feature 105 is both the lowermost and the uppermost one. Similarly, the attachment bracket 104 includes a floor portion 108 and a notch 111 to engage the end 12 and the circumferential bead 9, respectively, of the header 2B. In this manner, displacement of the heat exchanger 1 relative to the frame 102 in the axial direction of the headers 2A, 2B is prevented.

The attachment bracket 104 is joined to the frame 102 through a pair of snap features 107 provided as part of the frame 102, which engage the attachment bracket 104 through apertures 112 of the bracket 104. This allows for assembly of the heat exchanger 1 into the module 101 without requiring discrete fasteners or tools, thereby decreasing overall cost. Additionally, such a snap feature allows for easy disassembly of the heat exchanger 1 from the module 101 in the case where service or replacement is necessary. In some embodiments one or more of the snap features 107 can instead be provided as part of the attachment bracket 104 and the corresponding apertures 112 can be provided on the frame 102. Furthermore, in some embodiments it may be preferable to use discrete fasteners such as screws or the like in order to more securely attach the heat exchanger 1 into the module 101.

The heat exchanger 1 can be assembled into the module 101 by first placing the header 2A into the retention features 105 so that the cylindrical portion 7 of the header 2A is disposed against the concave cylindrical surface of the retention features 105, the end 12 of the header 2A is disposed against the floor portion 106, and the circumferential bead 9 of the header 2A is received into the notch 113. The attachment bracket 104 is then assembled to the header 2B while the heat exchanger 1 is oriented such that the face 41 is at a non-parallel angle to its final orientation. The bracket 104 is assembled to the header 2B by placing the concave cylindrical surface 110 against the cylindrical portion 7 of the header 2B and the floor portion 108 against the end 12 of the header 2B and receiving the circumferential bead 9 of the header 2B into the notch 111. The heat exchanger 1 is then rotated about the axis of the header 2A into its final orientation, thereby engaging the snap features 107 with the apertures 112. The heat exchanger 1 can subsequently be removed from the module 101 by disengaging the sanp features 107 and reversing the process.

Assembly of the heat exchanger 1 into the module 101 in this manner provides for easy and low-cost manufacturing. By using the circumferential bead 9 of the headers 2, the need for additional mounting parts that would need to be joined to the headers 2 can be avoided. As an additional advantage the attachment bracket 104 can prevent the undesirable movement of airflow into or out of the gap between the heat exchanger 1 and the heat exchanger 103 through a side of the module 101.

Various alternatives to the certain features and elements of the present invention are described with reference to specific embodiments of the present invention. With the exception of features, elements, and manners of operation that are mutually exclusive of or are inconsistent with each embodiment described above, it should be noted that the alternative features, elements, and manners of operation described with reference to one particular embodiment are applicable to the other embodiments.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention.

What is claimed is:

1. A method of making a header for a heat exchanger, comprising:

forming a cylindrical tube from a sheet of aluminum material;

piercing a plurality of tube receiving slots through a wall of the cylindrical tube;

forming a circumferential bead into the cylindrical tube at a location between a first open end of the cylindrical tube and a nearest one of the plurality of tube receiving slots to the first open end, forming the circumferential bead comprising, clamping a portion of the cylindrical tube within a die with a clamping force sufficient to resist axial displacement of the cylindrical tube during the forming operation, at least one of the tube receiving slots being located within said portion, receiving protrusions extending from the die into the at least one of the tube receiving slots located within the clamped portion, applying an axial force to the cylindrical tube at the first open end, and displacing a portion of the tube wall into a recess provided within the die at a location immediately adjacent the clamped portion; and reducing in diameter that portion of the cylindrical tube between the first open end and the circumferential bead.

2. The method of claim 1, further comprising inserting an end cap into a second open end of the cylindrical tube opposite the first open end.

3. The method of claim 1, further comprising forming a hose bead into the first open end of the cylindrical tube.

4. The method of claim 1, wherein piercing a plurality of tube receiving slots comprises:

clamping an outer surface of the cylindrical tube within a die;

internally pressurizing the cylindrical tube using a fluid; and displacing a plurality of punches in a radially inward direction of the cylindrical tube to pierce through the wall of the cylindrical tube.

5. The method of claim 4, wherein displacing a plurality of punches in a radially inward direction of the cylindrical tube to pierce through the wall of the cylindrical tube forms inwardly directed flanges surrounding each of the plurality of tube receiving slots.

6. The method of claim 1, wherein piercing the plurality of tube receiving slots occurs prior to forming the circumferential bead and prior to reducing in diameter that portion of the cylindrical tube between the first open end and the circumferential bead.

7. The method of claim 1, wherein reducing in diameter that portion of the cylindrical tube between the first open end and the circumferential bead comprises:

placing the cylindrical tube within a die so that a surface of the circumferential bead located furthest from the first open end is disposed against a surface of the die;

moving a ram towards the die from the open end of the cylindrical tube, thereby displacing a portion of the cylindrical tube between the open end and the circumferential bead into an annular groove of the ram; and applying a resistive force against said surface of the circumferential bead disposed against the die to prevent axial movement of the cylindrical tube while moving the ram.

* * * * *